US010495431B2

(12) United States Patent
Barzilai

(10) Patent No.: US 10,495,431 B2
(45) Date of Patent: Dec. 3, 2019

(54) CONTAINERS FOR EXPLOSIVES AND POSITIONING APPARATUSES FOR THE SAME

(71) Applicant: Yoav Barzilai, Ashkelon (IL)

(72) Inventor: Yoav Barzilai, Ashkelon (IL)

( * ) Notice: Subject to any disclaimer, the term of this patent is extended or adjusted under 35 U.S.C. 154(b) by 0 days.

(21) Appl. No.: 15/393,300

(22) Filed: Dec. 29, 2016

(65) Prior Publication Data

US 2017/0184379 A1 Jun. 29, 2017

Related U.S. Application Data

(60) Provisional application No. 62/272,101, filed on Dec. 29, 2015.

(51) Int. Cl.

| | |
|---|---|
| ***F42D 1/02*** | (2006.01) |
| ***F42D 3/00*** | (2006.01) |
| ***F42B 3/02*** | (2006.01) |
| ***F42B 4/20*** | (2006.01) |

(52) U.S. Cl.

CPC ..... *F42D 1/02* (2013.01); *F42B 3/02* (2013.01); *F42B 4/20* (2013.01); *F42D 3/00* (2013.01)

(58) Field of Classification Search

CPC ..... F42D 1/02; F42D 3/00; F42D 3/02; F42B 3/00; F42B 3/02; F42B 4/20

USPC ..... 102/301, 310, 314, 317, 319, 320, 321, 102/322, 331, 332; 89/1.14

See application file for complete search history.

(56) References Cited

U.S. PATENT DOCUMENTS

| | | | | | |
|---|---|---|---|---|---|
| 3,335,664 | A * | 8/1967 | Enzian | B21D 28/007 | 102/307 |
| 4,015,526 | A * | 4/1977 | Bond | F42B 3/02 | 102/331 |
| 4,815,384 | A * | 3/1989 | Ringel | F42B 3/08 | 102/307 |
| 4,856,430 | A * | 8/1989 | Gibb | F42B 3/08 | 102/307 |
| 5,377,594 | A * | 1/1995 | Alford | B21D 28/00 | 102/308 |
| 6,453,788 | B1 * | 9/2002 | Lebet | F42B 1/02 | 102/306 |
| 7,337,703 | B2 * | 3/2008 | Sansolo | F42D 3/00 | 102/307 |
| 7,802,509 | B2 * | 9/2010 | Wall | F41A 35/00 | 89/1.14 |
| 8,006,621 | B1 * | 8/2011 | Cherry | B26F 3/04 | 102/307 |
| 8,365,666 | B1 * | 2/2013 | Hooke | F41H 13/00 | 102/306 |
| 8,904,935 | B1 * | 12/2014 | Brown | F42B 3/08 | 102/310 |

(Continued)

FOREIGN PATENT DOCUMENTS

| | | | | |
|---|---|---|---|---|
| DE | 2551608 B1 * | 4/1977 | | B26F 3/04 |
| FR | 2906023 B1 * | 2/2009 | | F42B 4/20 |
| WO | WO-03073035 A2 * | 9/2003 | | F42B 3/00 |

*Primary Examiner* — James S Bergin

(74) *Attorney, Agent, or Firm* — Mark M. Friedman

(57) ABSTRACT

An assembly for holding and positioning explosive material, the arrangement including: (a) a container for holding the explosive material; and (b) a positioning apparatus including: (i) a holding element adapted to hold the container, and (ii) a mounting piece operationally coupled to the holding element, the mounting piece adapted to operationally couple the positioning apparatus to a target surface.

16 Claims, 8 Drawing Sheets

(56) References Cited

U.S. PATENT DOCUMENTS

| | | | | |
|---|---|---|---|---|
| 9,010,246 | B2 * | 4/2015 | Leppanen | F42D 1/22 102/306 |
| 9,175,933 | B2 * | 11/2015 | Patel | F41H 11/12 |
| 9,644,925 | B1 * | 5/2017 | Hollis | F42B 1/028 |
| 9,829,296 | B1 * | 11/2017 | Askin | F42D 5/04 |
| 2005/0126420 | A1 * | 6/2005 | Givens | F42B 1/02 102/310 |

* cited by examiner

B-B ( 0.2 ) TYP5

757
758
754/750

754 / 750
110
752
758
756
700

CONTAINERS FOR EXPLOSIVES AND POSITIONING APPARATUSES FOR THE SAME

This patent application claims priority from, and the benefit of, U.S. Provisional Patent Application No. 62/272,101, filed Dec. 29, 2015, which is incorporated in its entirety as if fully set forth herein.

FIELD OF THE INVENTION

The present invention relates to explosive materials and, more particularly, to devices for holding and positioning explosive material.

BACKGROUND OF THE INVENTION

Explosive material such as TNT and Semtex is often used for various demolition purposes in both civilian and military situations. There exists an entire art and science to the positioning of the explosive material in order to achieve the desired results. Blocks of explosives cannot easily be positioned when the desired direction of the blast is different from the angle of the surface that the material is attached to.

SUMMARY OF THE INVENTION

According to the present invention there is provided an assembly for holding and positioning explosive material, the arrangement including: (a) a container for holding the explosive material; and (b) a positioning apparatus including: (i) a holding element adapted to hold the container, and (ii) a mounting piece operationally coupled to the holding element, the mounting piece adapted to operationally couple the positioning apparatus to a target surface.

According to further features in preferred embodiments of the invention described below the holding element is fixed relative to the mounting piece.

According to still further features in the described preferred embodiments the holding element is adjustable relative to the mounting piece.

According to still further features the explosive material is selected from primer cord, hand-malleable explosive material and non-hand-malleable explosive material.

According to still further features the container is tubular. According to still further features the container is a preform. According to still further features the assembly further includes a cap adapted to secure a detonating mechanism in the container.

According to still further features the positioning apparatus includes a plurality of holding elements. According to still further features each of the holding elements is adjustable relative to the mounting piece. According to still further features each of the holding elements is fixed relative to the mounting piece.

According to still further features the positioning apparatus includes a coupling arrangement configured for coupling the positioning apparatus to at least one other positioning element. According to still further features the positioning apparatuses are operationally coupled together by the coupling arrangement and disposed in fixed orientation to each other. According to still further features the operationally coupled positioning apparatuses are adjustable relative to each other.

According to still further features the mounting piece further includes a mounting surface adapted to receive an adhering medium for coupling the mounting piece to the target surface.

According to still further features the container includes a shaping piece disposed in a bottom portion of the container. According to still further features the container includes an elongated shaping piece disposed lengthwise within the container. According to still further features the container is disposed within a sleeve, the sleeve having pieces of shrapnel disposed therein.

The present invention successfully addresses the shortcomings of the presently known methods for placement of explosive material and direction of the resulting blast.

BRIEF DESCRIPTION OF THE DRAWINGS

Various embodiments are herein described, by way of example only, with reference to the accompanying drawings, wherein:

FIG. 5A-5D illustrate different views of another embodiment of an explosive assembly according to the present invention;

DESCRIPTION OF THE PREFERRED EMBODIMENTS

The present invention discloses containers for explosive material and devices for positioning the containers. In general, the innovative explosive assembly/arrangement (e.g. assembly 100 of FIG. 2) includes a container (e.g. container 110 of FIG. 2) filled with plastic explosive and a positioning apparatus (e.g. positioning apparatus 150 of FIG. 2) that holds the container, allows for optimum positioning of the container for preferred blast effectiveness and is adapted for mounting the container on the target surface.

The principles and operation of explosive materials holding and positioning apparatus according to the present invention may be better understood with reference to the drawings and the accompanying description.

Container

In one preferred embodiment, the present invention uses test tube shaped plastic container such as plastic beverage containers before they have been heated and blown into the regular shape for commercial use. The preformed plastic container is called a parison or preform. In other embodiments, the containers are open ended tubes. The tubes may be specifically manufactured. Alternatively, the containers may be commercially available preforms. While the term 'preform' is generally used herein, it is made clear that the container may type of container that has the same general dimensions as a preform, but is not specifically limited to such dimensions. The terms 'container', 'canister', 'cylinder', 'housing', 'tube', 'preform', 'parison' and their variations will be used interchangeably herein.

Figure 1B:
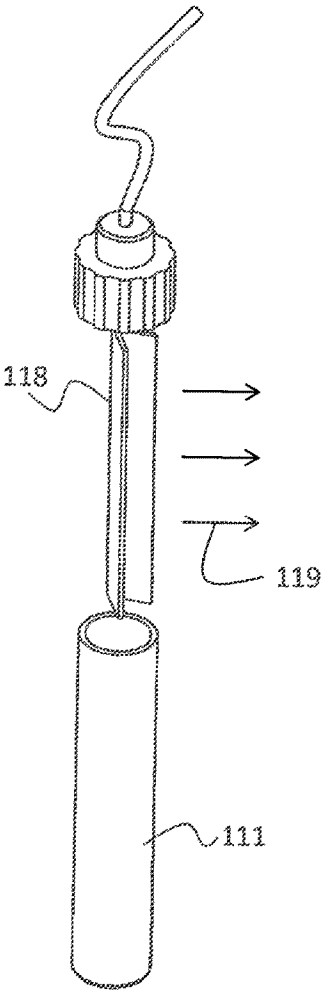
FIG. 1A-1C are exploded views of two additional configurations of the device.
Figure 1A:
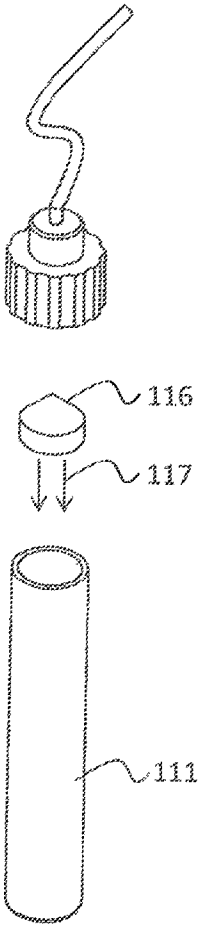
Figure 1:
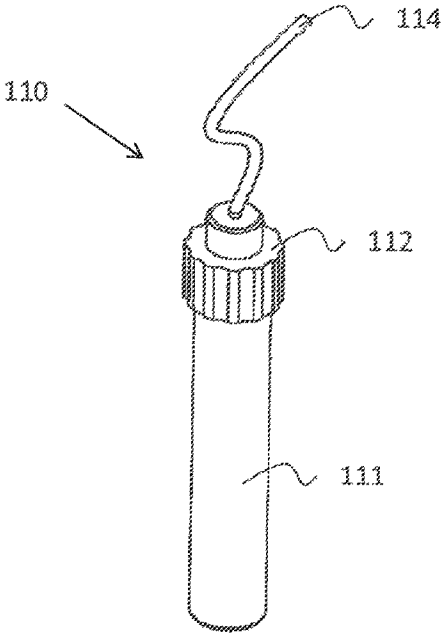
FIG. 1 is a tubular container 110 used in the immediate invention to house explosive material.

Referring now to the drawings, FIG. 1 illustrates a tubular container 110 used in the immediate invention to house explosive material. The tubular container consists of a body 111 and a cap 112. The cap holds the detonating mechanism which is exemplarily represented by a detonator line 114 contains the necessary materials to ignite the main explosive material. Solid state explosive material can be specially prepared according to the shape of the container, so that the desired amount of material fits into the containers. Alternatively, malleable or plastic explosives can be used to fill the containers.

A plastic explosive is a soft and hand-moldable solid form of explosive material. Within the field of explosives engineering, plastic explosives are also known as putty explosives. Plastic explosives are especially suited for explosive demolition. Common plastic explosives include Semtex and C-4. In the immediate application, explosive material such as Semtex is very malleable and can be easily rolled into a shape that fits inside the parison.

The use of plastic explosives affords a great deal of flexibility for demolition experts and devices can be assembled or modified on the fly during a military operation that includes a demolition aspect, such as breaching a house or compound). Furthermore, using plastic explosives with the currently disclosed holding and positioning assemblies solves a well-known problem in the field of demolition, especially military demolition. Armies of friendly countries often train and share knowledge and expertise in a cooperative manner. Demolition experts from one military may travel to another, friendly, country to train the local demolition experts.

It is difficult to transport explosive materials from one country to another. Countries that export explosives send the explosive consignments in large shipping containers which are carefully packed and prepared for transport of dangerous materials and often sent under special supervision. However, it is extremely difficult to send small amounts of explosives (for training purposes) across borders, and it is often the case that the explosives need to be transported relatively quickly and/or may be specialized explosives.

The immediate invention, which uses plastic tube containers and specialized holding and positioning apparatuses, solves the problem of transporting specialized explosive devices. The currently disclosed devices (and variations thereof) can be easily transported from country to country and the local military can provide the plastic explosives that are then loaded into the containers locally. Using this method, there is no need to transport any explosives at all. Therefore, the present invention obviates the need for transporting specialized explosive devices across borders.

In FIG. 1, container 110 is filled with the desired amount of explosive material and cap 112 is closed over the top of the container. In one embodiment the cap is a friction-sealing cap which is be pushed onto the top of the container or levered off the container. In another embodiment, the container is a preform has a neck ring or collar and a threaded finish (shown in FIG. 4). A modified cap is used to hold the fuse or wires that facilitate detonation of the explosive material. The cap is a screw top lid that is screwed over the open end of a preform. The cap has an internal thread that corresponds to the threaded finish of the preform. The cap looks like a modified beverage cap. A detonator line 114 extends through the top of the cap. Various means for igniting the main explosive material housed in container 110 are known in the art. The detonating means employed in the devices disclosed herein are intended to encompass any and all applicable detonating means and are generally and generically referenced as detonating means 114.

FIGS. 1A and 1B depict two additional configurations of the explosive device 110. In FIG. 1A, is an exploded view of an explosive device with a shaped charge according to the immediate invention. A shaping piece 116 is inserted in the bottom of the container 110 and the rest of the container is filled with explosive material (i.e. the explosive material is only located above the shaping piece, leaving an empty space between the shaping piece and the bottom of the container). The detonating mechanism is arranged and cap 112 is closed over the mouth of the container body 111.

In one preferred embodiment, shaping piece 116 has a rounded bottom section, for fitting into the rounded bottom of the test-tube shaped preform. The upper part of the shaping piece 116 is chevron shaped. The chevron points in the opposite direction of the shaped charge. That is to say that when the chevron points towards the blasting cap, the direction of the blast is away from the blasting cap, in the direction of arrows 117. Shaped charges focus the blast in the selected direction, concentrating the blast energy in a narrow beam or jet. Shaped charge 116 can be used for pinpoint blasting with a great deal of energy (e.g. penetrate thick armor or destroy a target which has a small surface area, such as a heavy door lock). FIG. 1A depicts what is termed herein as a 'standing' shaped charge.

FIG. 1B is an exploded view of a second configuration of a shaped charge according to the immediate invention. The explosive device depicted in FIG. 1B is termed herein a 'lying down' or 'lengthwise' shaped charge. An elongated shaping piece 118 is inserted lengthwise into container body 111. Explosive material is packed between the chevron-shaped piece 118 and the inner surface of the container, on the side of the piece to which the chevron shape points. The shaping piece tents over the empty space between the shaping piece and the inner surface of the container. The elongated shaping piece disperses the energy of the blast along the length of the container to form an elongated, narrow jet of energy (which cuts like a knife) in the direction of arrows 119 (i.e. opposite the direction the chevron shape points).

Figure 1C:
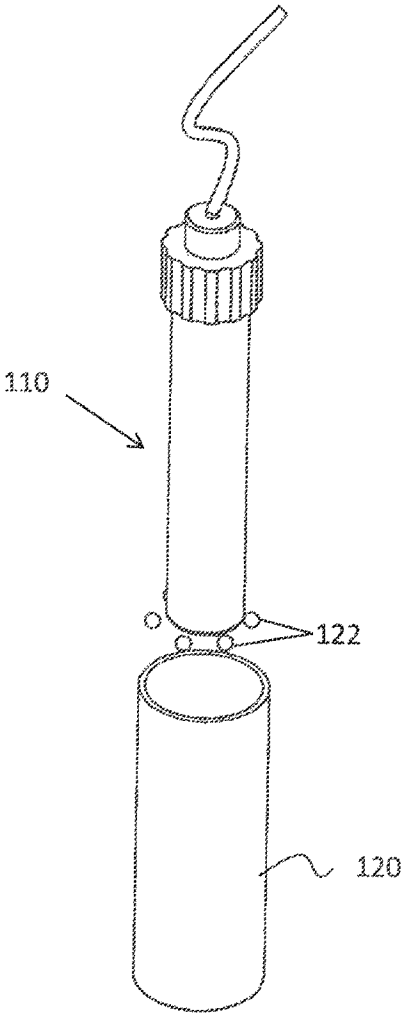

FIG. 1C is an exploded view of another embodiment of an explosive device according to the immediate invention. FIG. 1C depicts an explosive device augmented with shrapnel. Container 110 is inserted into a tubular sleeve 120 which is filled with shrapnel 122 (e.g. small steel balls). In embodiments, the shrapnel is held in some form of a matrix (e.g. a resin matrix) which forms the sleeve. In embodiments, the tubular sleeve is a housing which contains the shrapnel/debris within the walls of the housing. In all embodiments, the sleeve is configured to have dimensions that allow container 110 to be inserted into the sleeve. When the explosive is detonated, the explosion causes the shrapnel to disperse at a high velocity creating a great deal of damage to any person or object in the blast radius. The destructive heat, concussive force of the blast and the bullet-like shrapnel combine to provide a lethal explosive device.

Container 110 can be modified in order to weaponize the device and adapt it for other methods of deployment. For example, the explosive device 110 can be used with a crossbow type launcher, e.g. for penetrating a window or wall from a distance. The bottom of the container can be modified to be tipped with a hook for embedding in the target and a disc can be added to prevent the container from passing through the target. Once the explosive device is positioned it can be detonated remotely.

Positioning Apparatus

A positioning apparatus is the second component of the positioning and directing arrangement/explosive assembly. Numerous configurations of positioning apparatuses are envisioned, but only some of these are discussed below. The various apparatuses and devices disclosed herein are merely exemplary, but are sufficiently enabling to provide the reader with an understanding of the scope of the invention.

In general, the positioning apparatus is made up of a holding piece/element and a mounting piece/component. The holding element is operationally coupled to the mounting piece. In some embodiments the holding element irremovably coupled to the mounting piece or coupled in a fixed, non-adjustable manner. In other embodiments, the holding element is adjustable relative to the mounting piece.

The mounting piece serves as a platform for operationally coupling the positioning apparatus to a target surface. In preferred embodiments, the mounting piece includes a mounting surface which is adapted to receive an adhering medium for operationally coupling the explosive arrangement to a target surface. In some embodiments a single mounting piece is operationally coupled to a plurality of holding elements/components. In some embodiments each of the holding components are adjustably coupled to the mounting piece. In other embodiments the holding elements are coupled to the mounting piece in a fixed, non-adjustable manner.

In preferred embodiments the positioning apparatus has a modular configuration what allows each positioning apparatus to be coupled with, or connected to, at least one other positioning apparatus and preferably two other positioning apparatuses (e.g. one on each side of the positioning apparatus). In embodiments, the positioning apparatuses are adjustable relative to each other. In other embodiments the positioning apparatuses are locked in fixed orientation relative to each other.

Various combinations and configurations can be manufactured based on the preceding description. Below, a number of exemplary combinations and configurations are provided to further illustrate and explain the inventive idea. The examples below are merely descriptive and not intended to limit the scope of the invention in any way.

Figure 2:
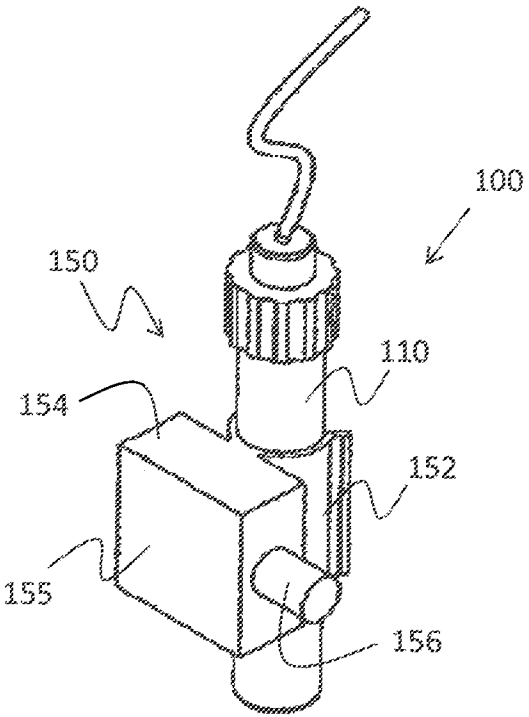
FIG. 2 is an exemplary embodiment of the assembly or arrangement for holding and positioning explosive material according to the present invention.

FIG. 2 depicts one exemplary embodiment of the assembly or arrangement for holding and positioning explosive material according to the present invention. Assembly 100 includes a container 110 and a positioning apparatus 150 for holding and positioning the explosive device (the terms container and 'explosive device' are used interchangeably herein to generally refer to container 111, cap 112 and detonating mechanism 114). In the depicted embodiment, container 110 is a tubular container. Positioning apparatus 150 is comprised of a holding element 152 and a mounting piece 154. In the depicted exemplary embodiment, the holding element 152 is fixed relative to the mounting piece 154. Holding element 152 is a slightly flexible clasp adapted to receive and hold container 110. The rounded fins of the clasp elastically deform to admit the container into the enclosure defined by the clasp.

Mounting piece 154 includes a mounting surface 155 which is flat to provide maximum diversity of use. The blasting arrangement/assembly is often adhered to a door or wall which needs to be breached. Some type of adhering medium is needed in order to stick the blasting arrangement to the target surface. In some embodiments the mounting surface is attached to the target surface with an adhesive material. Some examples of adhesive material include putty, double-sided tape, double-sided foam-tape, superglue, rubber cement, contact adhesives and the like. In some embodiments the adhesive medium is a hook and loop fastener which includes one strip with the hook material and one strip with the loop material. One of the strips is stuck on the mounting surface and the other strip is stuck on the target surface. The blasting arrangement can then be attached to the target surface. In some embodiments the adhering medium is magnetic tape (that is coated with adhesive glue or lined with double-sided tape on one side) or even a magnetized mounting surface.

Mounting piece 154 further includes a coupling arrangement 156 which allows the positioning apparatus to be coupled to at least one other positioning apparatus and preferably to two other apparatuses. Exemplarily, the coupling arrangement 156 includes a circular rod which fits into a corresponding circular socket on a second positioning apparatus. Preferably the rod is frictionally lodged in the socket to create an adjustable connection that allows for setting one positioning apparatus at a desired angle relative to the other positioning apparatus. Exemplarily, mounting piece 154 includes a round socket (not shown) on the opposite side of mounting piece to the circular rod. Alternatively, mounting piece 154 has disposed there-through a circular channel which is adapted to receive circular rods of differing lengths. A plurality of positioning apparatuses can be coupled together on a single rod. The number of positioning units that can be connected together depends on the length of the rod that runs through all of the units.

Figure 3:
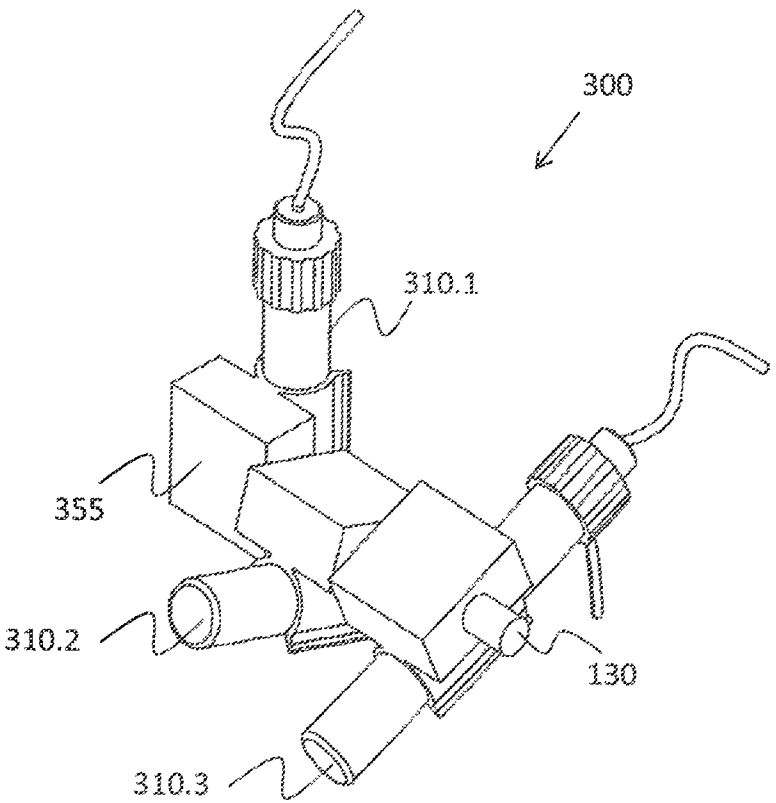
FIG. 3 is an assembly which consists of three positioning apparatuses which are coupled together via a coupling arrangement.

FIG. 3 depicts an assembly 300 which consists of three positioning apparatuses 350 (identical to positioning apparatus 150) which are coupled together via a coupling arrangement 356 (identical to coupling arrangement 356). Each of the three positioning apparatuses consists of a holding element 352 and a mounting piece 354. Each holding element holds one explosive device 310 (310.1, 310.2, 310.3). Together, the three connected units form the single blast arrangement/assembly 300. In the depicted embodiment, the positioning apparatuses are adjustable relative to each other. Each positioning apparatus can be individually rotated about the common axis defined by the rod (or rods) of the coupling arrangement(s) generally referenced 356. In the figure, each of the positioning apparatuses is arranged at a different angular degree relative to the other positioning apparatuses. In the current figure and the following figures, corresponding elements are labeled with corresponding reference numbers except that the first reference number corresponds to the Figure number.

In one exemplary embodiment, each of the containers 310.1, 310.2 and 310.3 is filled with explosive material. In other exemplary embodiments, the containers are configured as shaped charges as depicted in FIG. 1A or 1B. In further exemplary embodiments, each container is configured in a different manner, selected from the configurations and embodiments discussed above in relation to FIGS. 1, 1A, 1B and 1C.

In general, even in a regular charge which is not a shaped charge (e.g. the embodiment depicted in FIG. 1) the energy that is released during the blast has a certain degree of directionality. The explosion generally expands outwards from the cap which holds the detonating mechanism in place. The main body of energy expands along the axis defined as passing between the center of the cap and the center of the bottom of the tube, in the direction away from the cap. This energy release is interchangeably referred to herein as either "direct" or "main" energy/force. There is of course a great deal of concussive force in other directions as well, including the directions transverse the direction of the aforementioned axis. This concussive force is referred to herein as "indirect" energy or force. As such, the general direction of the blast can be directed to a certain degree by positioning the container at different angles relative to the target surface.

Figure 4:
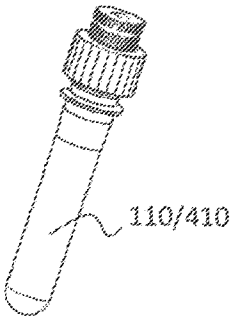
FIG. 4 is an embodiment of the invention where the container is a preform.
Figure 4A:
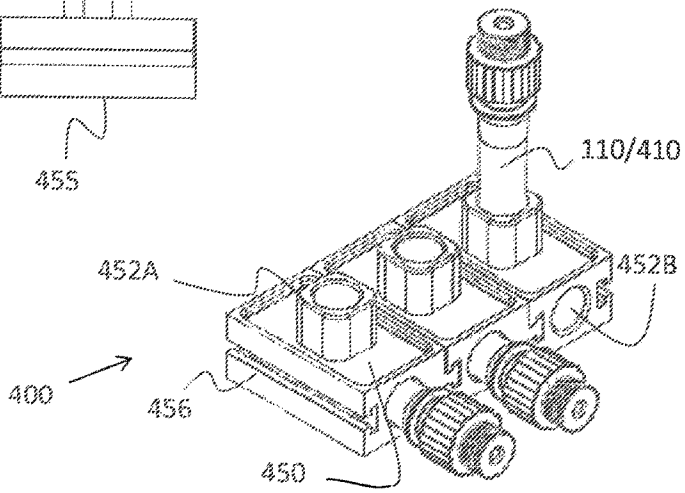
FIGS. 4A and 4B illustrate different views of a explosive assembly 400.
Figure 4B:
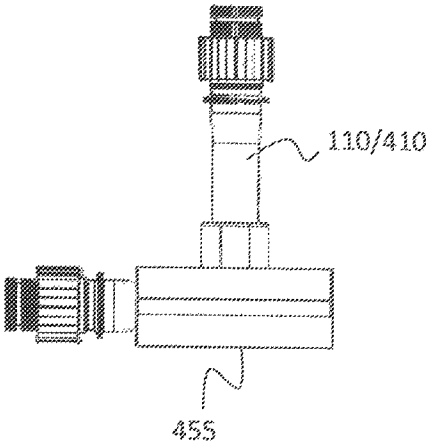

FIG. 4 depicts an embodiment of the invention where the container is a preform 410. For the sake of consistency all containers are referenced hereafter by the number 110, whether the depicted container is regular tube or a preform. FIGS. 4A and 4B illustrate different views of a explosive assembly 400 according to the present invention. FIG. 4A illustrates an isometric view of assembly 400. FIG. 4B is a perspective side view of assembly 400.

Three modular positioning apparatuses 450 are coupled together via interlocking coupling arrangements 456. The holders are coupled together by a tongue and groove arrangement 456 where the tongue is disposed on one side of the mounting piece 454 and the groove is disposed on the opposite side thereof. The modular design of the positioning apparatus allows for scalability. Of course, other coupling arrangements could equally be used, such as magnetic coupling (e.g. one side magnet one side metal plate), adhesive coupling or any other mechanical coupling arrangement.

In the exemplary embodiment, each positioning apparatus 450 includes two holding elements 452. A first holding element 452A is disposed perpendicular to the generally planar orientation of the apparatus, and specifically the orientation of the mounting surface 455. The holding element 452A defines an aperture for receiving the bottom end of container 110. Container 110.1 loaded in holding element 452A.1 and is oriented perpendicular to the plane of the mounting surface 455.

The second holding element 452B is disposed lengthwise within the body of the positioning apparatus 450, parallel to the mounting surface 455. Containers 110.2 and 110.3 are loading in holding elements 452B.2 and 452B.3 respectively and are both oriented parallel to the mounting surface 455. Positioning apparatus 450 is an example of a positioning apparatus that has a holding element (in this case two holding elements) which is fixed or non-adjustable relative to the mounting piece 454

As discussed above, orientation of the container 110 relative to the target surface (and hence relative to the mounting surface) dictates the direction of the main energy from the blast and indirect energy or concussive force. As mentioned, the plane of the mounting surface is usually parallel to the plane of the target surface. Therefore, in order to direct the main energy of the blast towards the target surface, the container must be oriented perpendicular to the mounting surface. For example, when breaching a heavy door, an assembly including a single positioning apparatus, is mounted on the door, opposite each hinge and an assembly including three positioning apparatuses is positioned opposite the lock. The main energy from the blasts destroys the hinges and lock, possibly propelling the door into the room.

On the other hand, in cases where it is sufficient to utilize the indirect energy of the blast to breach a door (e.g. a door which is not heavily fortified), one of more containers are positioned parallel to the target surface. As a result of the indirect, concussive force, the simple door will be breached, but without causing too much damage to the area beyond the door. A demolition expert can gauge the amount and force needed for a particular job and use either one, two or three explosive devices (e.g. in assembly 400) and orientate each of the device according to need, such as all laying parallel, all sitting perpendicular or some sitting one way and others laying another way, e.g. as depicted in FIGS. 4A, 4B.

Figure 5A:
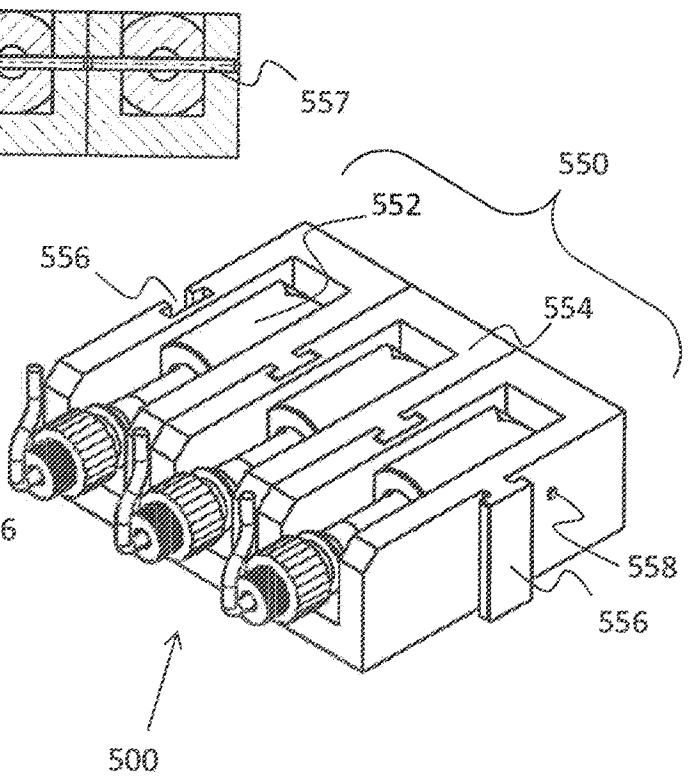
Figure 5B:
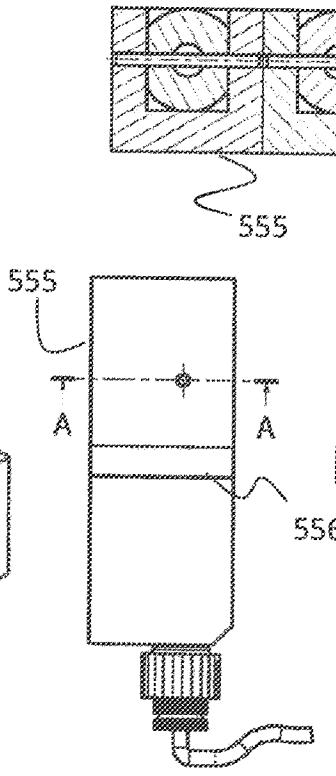

FIGS. 5A-5D illustrate different views of another embodiment of an explosive assembly according to the present invention. FIG. 5A illustrates an isometric view of assembly 500. FIG. 5B is a perspective side view of assembly 500. FIG. 5C is a cross-sectional view along the AA line of FIG. 5B. Also here, exemplarily, three positioning apparatuses 550 are assembled together via an exemplary tongue and groove coupling arrangement 556.

In a immediate configuration, each positioning device 550 includes a holding element 552 which is adjustable relative to the mounting piece 554. Exemplarily, the mounting piece 554 defines a channel 564 (see FIG. 5D) in which the holding element 552 is disposed. The holding element and container 110 lie in the channel when orientated parallel to mounting surface 555, as depicted.

Figure 5D:
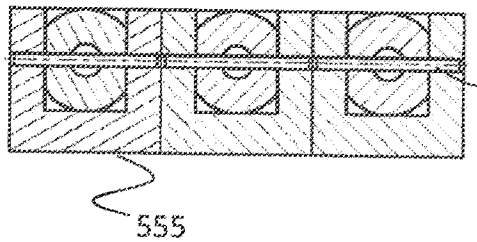
Figure 5D:
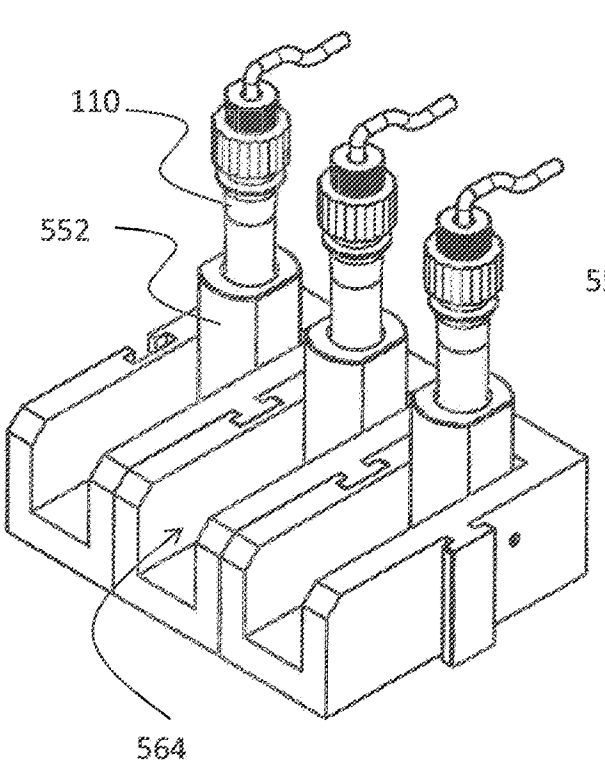

Holding element 552 is adjustably coupled to mounting piece 554 via an adjustable coupling means. The exemplary adjustable coupling means includes a hinge/rod 557 (shown in FIG. 5C) which runs through the base of the holding element, the ends of which are disposed in pinholes 558. The holder, in the depicted exemplary embodiment, can be rotated through a 90° are about the hinge axis between the parallel and perpendicular positions. The hinge is preferably a stiff hinge the allows the container to be held at any angle along the 90° arc. FIG. 5D illustrates assembly 500 with the holding elements and explosive devices positioned perpendicular in relation to the mounting surfaces 555.

Exemplarily, explosive devices 110 can be set at a 45° angle such that the main energy from the blast is directed towards the ground, on the other side of the target surface. Going back to the example of breaching a lock of a heavily fortified door, it is conceivable that directing the blast perpendicular to the surface of the door would cause the lock to become a dangerous projectile which is launched into the area behind the door. The lock could inadvertently cause casualties among innocent bystanders or subjects who are wanted alive. Therefore, by angling the blast towards the floor, the likelihood of unintended damage or fatalities can be minimized.

Figure 6:
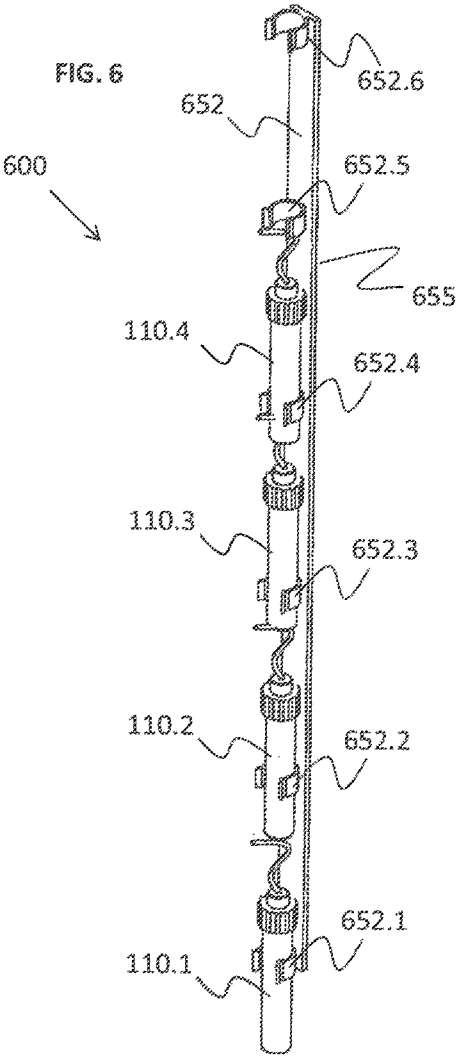
FIG. 6 is an isometric view of an assembly that includes a mounting piece with multiple holding elements and explosive devices populating most of the holders.

Another possible configuration is shown in FIG. 6. FIG. 6 depicts an assembly 600 that includes a mounting piece 654 with multiple holding elements 652 and explosive devices 110 populating most of the holders. In the exemplary assembly depicted in the figure there are six holding elements 652 (652.1-652.6), four of which (652.1-652.4) are populated with explosive devices 110 (110.1-110.4). Assembly 600 can be mounted on a target surface by applying an adhering medium to mounting surface 655 and bringing the mounting surface into contact with the target surface. Assembly 600 is an example of an assembly that includes a mounting piece with multiple holding elements that are coupled in a fixed, non-adjustable manner to the mounting piece.

Figures 7A, 7B, 7C, 7D, 7E:
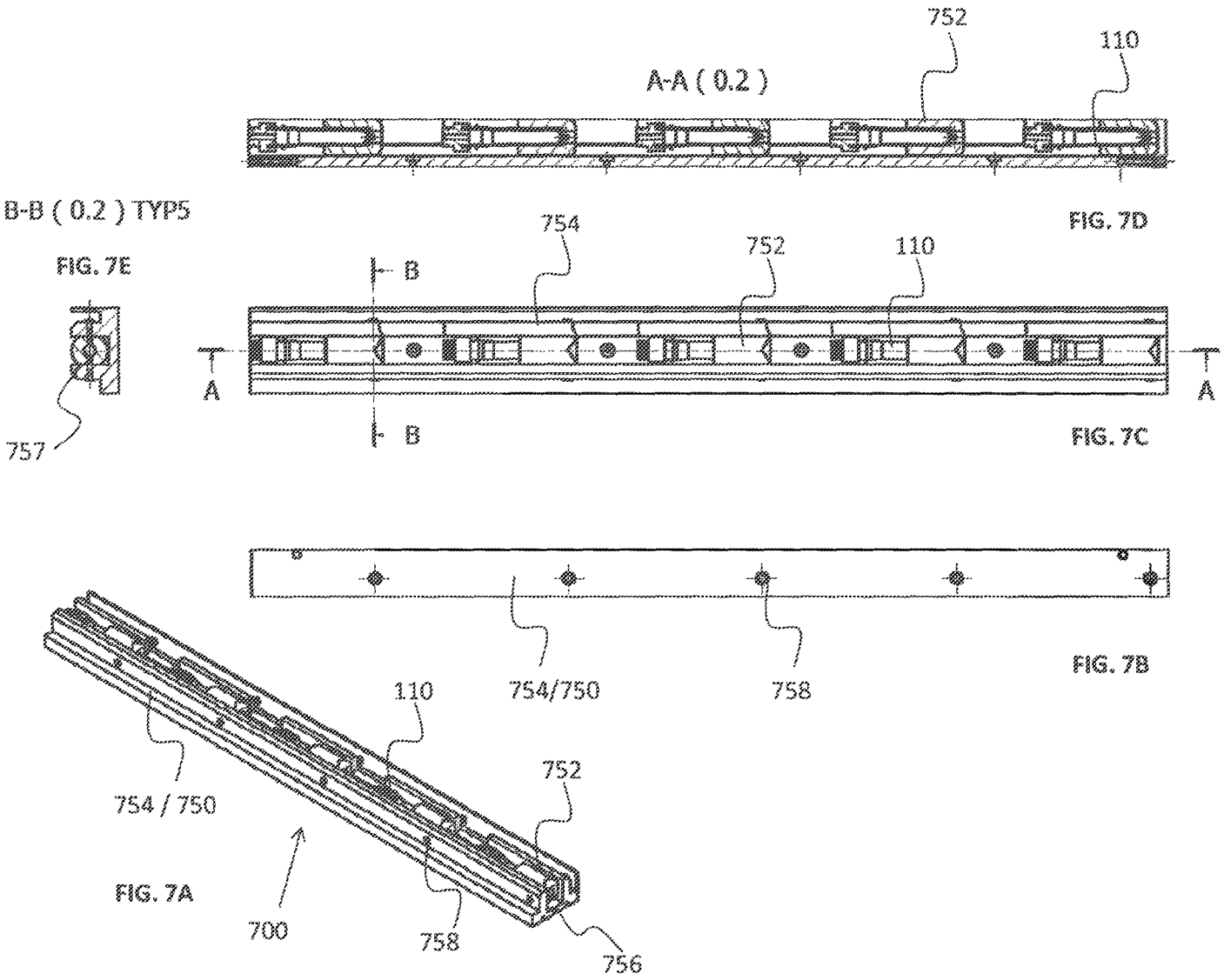
FIG. 7A-7E depict various views of an exemplary embodiment the immediate invention.

FIGS. 7A-7E depict various views of an exemplary embodiment the immediate invention. FIG. 7A is an isometric view of assembly 700 according to an embodiment of the immediate invention. FIG. 7B is a perspective view of assembly 700. FIG. 7C is a top-down view of assembly 700. FIG. 7D is a cross-sectional view of cross section AA of FIG. 7C. FIG. 7E is a cross-sectional view of cross section BB of FIG. 7C.

In the figures, five holding elements 752 are mounted in a row and disposed in a channel defined by mounting piece 754. Similar to the embodiment depicted in FIG. 5, each of the holding elements 752 is adjustably coupled to the mounting piece 754 via an adjustable coupling means. The exemplary adjustable coupling means depicted includes a hinge/rod 757 (shown in FIG. 7E) which runs through the base of the holding element, the ends of which are disposed in pinholes 758. Positioning apparatus 750/mounting piece 754 is adapted to coupled to a second mounting piece/positioning apparatus via coupling arrangement 756, part of which is embodied in the mounting piece in the form of a female socket.

The holding element, in the depicted exemplary embodiment, can be rotated through a 90° arc about the hinge axis between the parallel and perpendicular positions. In some embodiments, the holding element can be rotated through a 180° arc (so long as the neighboring device is not in the way). The hinge is preferably a stiff hinge the allows the container to be held at any angle along the 90°/180° arc. Assembly 700 is an example of an assembly that includes a mounting piece with multiple holding elements that are adjustably coupled to the mounting piece.

Figure 8B:
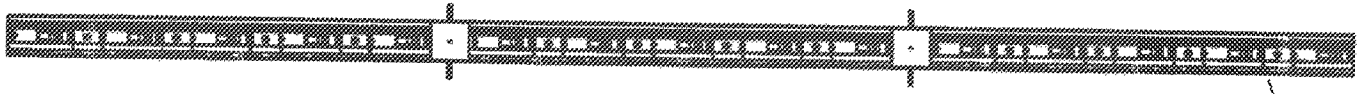
FIGS. 8A and 8B are two views of an assembly which includes multiple row modules which are connected together by connector pieces.
Figure 8D:
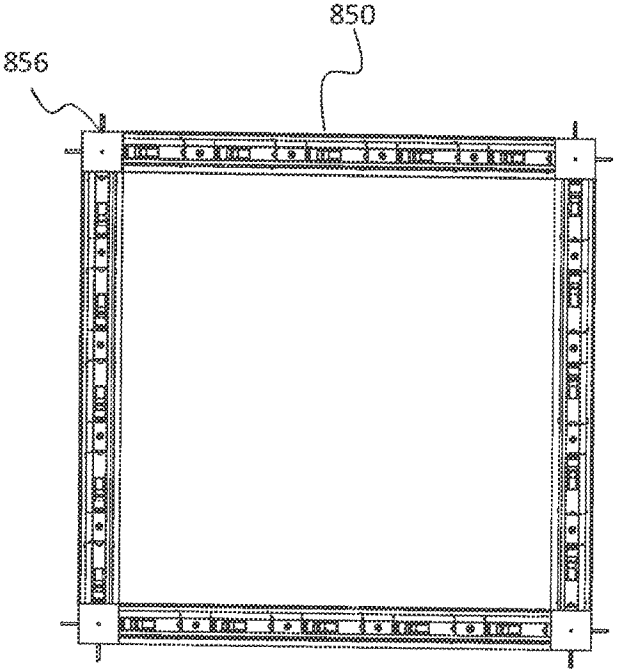
FIGS. 8C and 8D are two views of an assembly which includes multiple row modules which are connected together by connector pieces in a second configuration.
Figure 8A:
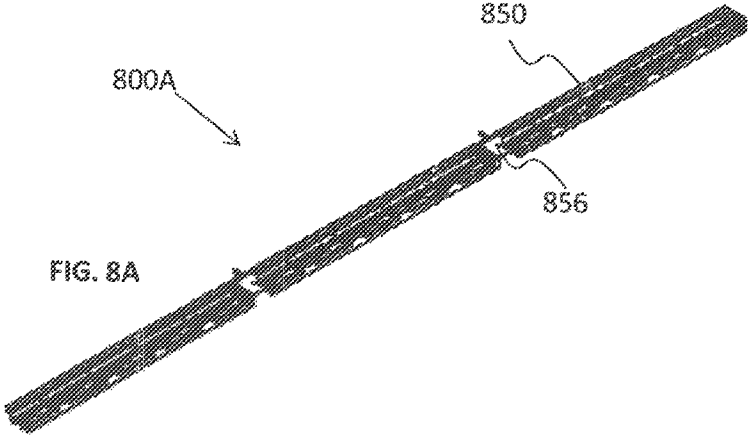
Figure 8C:
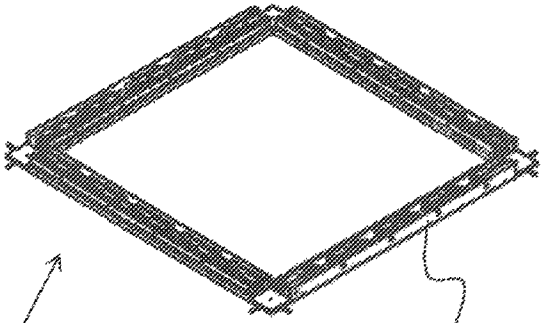

FIGS. 8A and 8B illustrate two views of an assembly 800A which includes multiple row modules (three modules where each module is similar to assembly 700) which are connected together by connector pieces. FIGS. 8C and 8D illustrate two views of an assembly 800B which includes multiple row modules (four modules) which are connected together by connector pieces in a different configuration to that of assembly 800A. The figures depict the versatility of the design concept, with only a few exemplary configurations. In both configurations, positioning apparatuses 850 are coupled together by exemplary connector pieces 856. Each connector piece has four male connector prongs and each positioning piece 850 has a aperture that serves as a female connector socket. Variations of the connector pieces can provide almost limitless scalability and versatility of use.

Figure 9A:
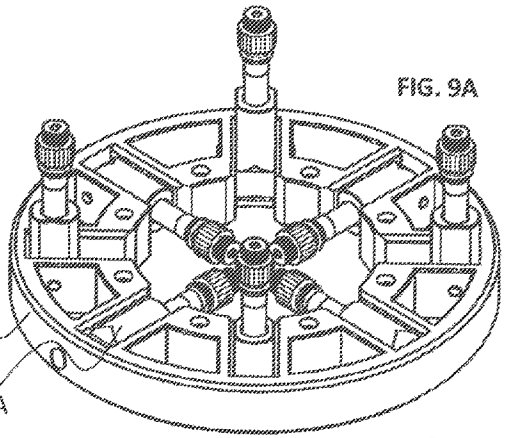
FIG. 9A-9E are various views two circular configurations.
Figure 9B:
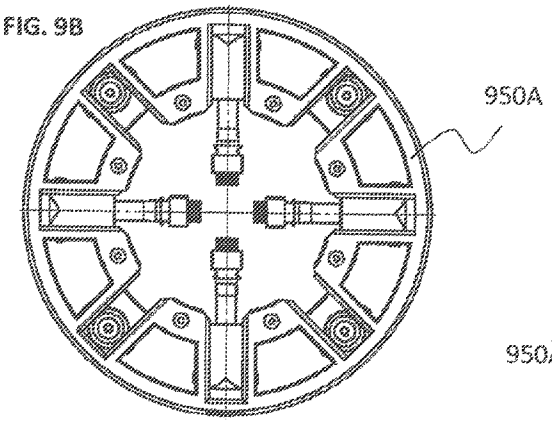

Yet another configuration is shown in FIGS. 9A-9E. FIGS. 9A and 9B depict one exemplary embodiment of a circular/wheel assembly 900A. FIG. 9A illustrates an isometric view of the assembly. FIG. 9B illustrates a top-down plan view of the assembly. Wheel 950A is a positioning apparatus/mounting piece that is exemplarily configured to hold eight explosive devices in the eight holding elements 952A. The wheel assembly is useful for breaching thick surfaces such as wall. The wheel is mounted on a target surface by adhering the mounting surface to the target surface. Like assembly 500, the holders can be moved within a 90° arc. In the depicted configuration the blast energy is equally divided both horizontally and vertically.

Figure 9C:
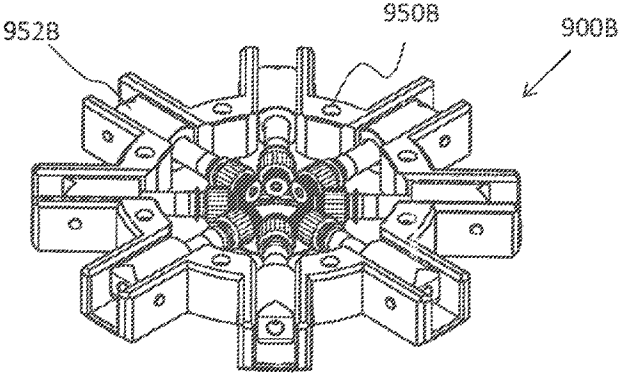
Figure 9D:
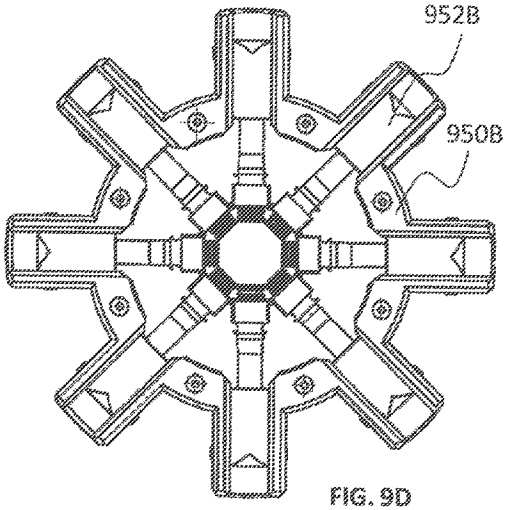
Figure 9E:
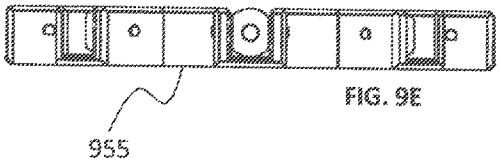

FIGS. 9C-9E depict another exemplary embodiment of a circular assembly 900B. FIG. 9C illustrates an isometric view of the assembly. FIG. 9D illustrates a top-down plan view of the assembly. FIG. 9E is a side/perspective view of the assembly. Positioning apparatus 950B can be mounted on a target surface by applying an adhering medium to mounting surface 955 as detailed elsewhere herein. Apparatus 950B is a positioning apparatus/mounting piece that is exemplarily configured to hold eight explosive devices in the eight holding elements 952B, similar to wheel 950A.

However, Positioning apparatus 950B differs from Wheel 950A in that each holding element is adapted to rotate about the axis of the coupling rod (not shown) through an arc of 180°. By positioning the containers towards the center of the circular hub 950B, the resulting blast radius is smaller that would be achieved if some or all of the containers were rotated outwards from the center of the hub. The breaching device provides can be manipulated to make a large or as small a hole as desired. Likewise, some containers can be removed to reduce the intensity of the blast. Still further, the blast can be directed at any desired angle, as discussed above.

Arranging Detonation Cords

Detonating cord (also called detonation cord, detacord, det. cord, detcord, primer cord or sun cord) is a thin, flexible plastic tube usually filled with pentaerythritol tetranitrate (PETN, pentrite) or Tetryl. With the PETN exploding at a rate of approximately 4 miles per second (7000 meters p/s), any common length of detonation cord appears to explode instantaneously. It is a high-speed fuse which explodes, rather than burns, and is suitable for detonating high explosives. The velocity of detonation is sufficient to use it for synchronizing multiple charges to detonate almost simultaneously even if the charges are placed at different distances from the point of initiation. It is used to reliably and inexpensively chain together multiple explosive charges.

Traditionally, explosive ordnance disposal technicians couple more than a detonation cord for improving reliably and effectiveness. Double stranding the detonation cord entails binding to cords together by wrapping electricians tape around the length of the cords. This is both time consuming and mind numbing work (which is dangerous when working with explosives!).

Innovatively, hook and loop fastener tape is adhered to the detonating cord. The hook surface is adhered to one side of the cord and the loop surface is adhered to the other side of the cord. When the operator wishes to couple two or more cords together (e.g. when multiple detonating cords are connected to multiple explosive devices and then coupled together to attached to a single detonating mechanism), the hook surface of one cord is pressed to the loop surface of the adjacent cord, thereby coupling the cords together. This configuration is scalable to any number of cords and the parallel cords can even be rolled together to form a cylindrical formation.

Figure 10:
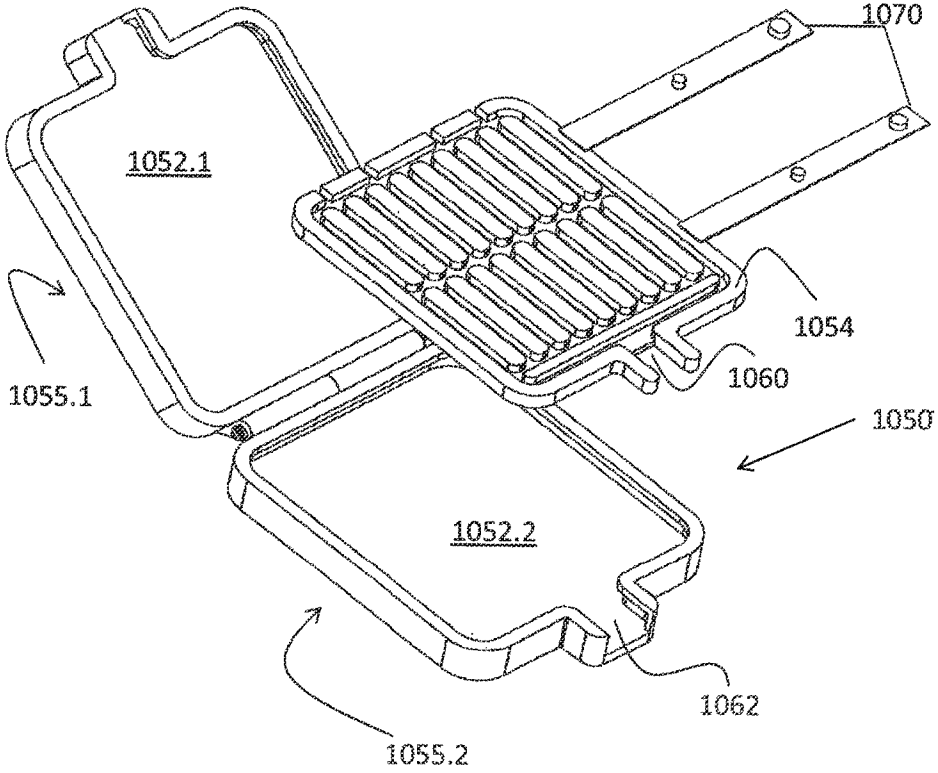
FIG. 10 is an assembly 1000 for holding and positioning explosive material.

Another possible configuration is shown in FIG. 10. FIG. 10 illustrates an assembly 1000 for holding and positioning explosive material. In one exemplary embodiment, primer cord is wound through the labyrinth of crevasses of the ribbed holding element/plate 1054. The primer cord can be threaded in any preferred configuration. Securing straps 1070 are folded over the ribbed section and fastened in order to hold the primer cord in place. In one embodiment, the two ends of the primer cord exit by prongs 1060. The holding element/plate 1054 is place inside positioning apparatus 1050 which closes book-like over the holding plate. The primer cord ends extend out of the opening 1062.

In another embodiment, each side of positioning apparatus is a mounting piece 1052 (1052.1, 1052.2) for a separate holding plate 1054 (not shown). The two mounting pieces are operationally coupled together via a coupling arrangement 1056 in the form of a hinge. The blast radius can be expanded by mounting the positioning apparatus in an open configuration on the target surface. An adhering medium is applied to each of the mounting surfaces 1055.1, 1055.2. If a blast with a smaller radius but greater intensity is needed, then the positioning apparatus can be closed book-like and only one mounting surface is mounted on the target surface. In embodiments (not shown), the assembly 1000 can be scaled up by adding additional coupling arrangements (e.g. hinges).

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. An assembly for holding and positioning explosive material for breaching, the assembly comprising:

(a) a container for holding the explosive material; and (b) a positioning apparatus including:

(i) a holding element into which said container is inserted, and (ii) a mounting piece rotationally coupled to said holding element via a hinge so as to rotationally position said container held within said holding element, said mounting piece adapted to operationally couple said positioning apparatus to a target surface, said mounting piece further including a mounting surface adapted to receive an adhering medium to facilitate coupling said mounting piece to said target surface; and wherein said holding element is rotatably adjustable relative to said mounting piece so as to direct a main concussive force of a blast emanating from the explosive material, wherein said positioning apparatus includes a plurality of holding elements.

2. The assembly of claim 1, wherein each of said holding elements is rotatably adjustable relative to said mounting piece so as to be rotated through a 90° are about an axis of said hinge.

3. The assembly of claim 1, wherein said explosive material is selected from primer cord, hand-malleable explosive material and non-hand-malleable explosive material.

4. The assembly of claim 1, wherein said container is tubular.

5. The assembly of claim 1, wherein said container is a preform.

6. The assembly of claim 1, further comprising a cap adapted to secure a detonating mechanism in said container.

7. The assembly of claim 1, wherein said positioning apparatus includes a coupling arrangement configured for coupling said positioning apparatus to at least one other positioning apparatus.

8. The assembly of claim 7, further comprising at least one additional positioning apparatus wherein said positioning apparatuses are operationally coupled together by said coupling arrangement and disposed in fixed orientation to each other.

9. The assembly of claim 8, wherein said operationally coupled positioning apparatuses are adjustable relative to each other.

10. The assembly of claim 1, wherein each of said holding elements is rotatably adjustable relative to said mounting piece.

11. The assembly of claim 1, wherein said container includes a shaping piece disposed in a bottom portion of said container.

12. The assembly of claim 11, wherein said container includes an elongated shaping piece disposed lengthwise within said container.

13. The assembly of claim 1, wherein said container is disposed within a sleeve, said sleeve having pieces of shrapnel disposed therein.

14. The assembly of claim 1, wherein each of said holding elements is rotatably adjustable relative to said mounting piece so as to be rotated through a 180° arc about an axis of said hinge.

15. The assembly of claim 1, wherein each of said holding elements is rotatably adjustable relative to said mounting piece so as to be rotated through a 90° arc about an axis of said hinge.

16. The assembly of claim 1, wherein each of said holding elements is rotatably adjustable relative to said mounting piece so as to be rotated through a 180° arc about an axis of said hinge.

* * * * *